US007047887B2

(12) United States Patent
Kinley

(10) Patent No.: US 7,047,887 B2
(45) Date of Patent: May 23, 2006

(54) HAND GRENADE

(75) Inventor: Ian Kinley, Järfälla (SE)

(73) Assignee: Forsvarets Materielverk, Stockholm (SE)

( * ) Notice: Subject to any disclaimer, the term of this patent is extended or adjusted under 35 U.S.C. 154(b) by 0 days.

(21) Appl. No.: 10/490,748

(22) PCT Filed: Oct. 11, 2002

(86) PCT No.: PCT/SE02/01861

§ 371 (c)(1),
(2), (4) Date: Apr. 12, 2004

(87) PCT Pub. No.: WO03/038369

PCT Pub. Date: May 8, 2003

(65) Prior Publication Data

US 2005/0115449 A1 Jun. 2, 2005

(30) Foreign Application Priority Data

Oct. 12, 2001 (SE) ..... 0103408

(51) Int. Cl.
*F42B 27/08* (2006.01)

(52) U.S. Cl. ..... 102/486; 102/489; 102/487

(58) Field of Classification Search ..... 102/486, 102/482, 404, 394, 489, 487
See application file for complete search history.

(56) References Cited

U.S. PATENT DOCUMENTS 3,175,489 A * 3/1965 Reed, Jr. ..... 102/404
3,434,418 A * 3/1969 Paul et al. ..... 102/404
3,831,521 A * 8/1974 Engeli ..... 102/404
3,868,905 A * 3/1975 Ragailler ..... 102/404
3,994,227 A * 11/1976 Harvey ..... 102/404
4,781,117 A 11/1988 Garnett et al.
4,782,757 A * 11/1988 Carter ..... 102/394
4,919,051 A 4/1990 Cohen
4,922,824 A 5/1990 Schubart
4,934,274 A * 6/1990 Mathey ..... 102/401
5,069,136 A * 12/1991 Axelson et al. ..... 102/425
5,142,986 A * 9/1992 Gundel ..... 102/401
5,866,841 A * 2/1999 Green et al. ..... 102/486
6,079,334 A * 6/2000 Roheim ..... 102/394
6,606,951 B1 * 8/2003 Klein ..... 102/416

FOREIGN PATENT DOCUMENTS

DE 38 17 265 A1 11/1989
GB 2 249 821 A 5/1992
NL 7511447 4/1976

* cited by examiner

*Primary Examiner*—M. Clement
(74) *Attorney, Agent, or Firm*—Jacobson Holman PLLC

(57) ABSTRACT

An airburst hand grenade constructed so as to jump 1–2 m above the ground before detonating. The hand grenade includes a detonator, a warhead, and support legs for raising the hand grenade from a horizontal position to an upright position once it has landed after being thrown. The detonator includes a delay unit, an upper charge which releases the support legs, a jump charge which propels the warhead into the air, and an explosive cartridge which initiates a main charge. Because the grenade detonates above ground, the fragments are spread essentially horizontally and at an angle to the ground and consequently attack the target from above, which results in a much larger target surface and the capability of spreading fragments behind a shelter.

22 Claims, 2 Drawing Sheets

HAND GRENADE

This is a nationalization of PCT/SE02/01861 filed Oct. 11, 2002 and published in English.

BACKGROUND OF THE INVENTION

1. Field of the Invention

The invention relates to a hand grenade with an airburst.

2. Description of the Related Art

Existing constructions of fragmentation hand grenades all have one basic shortcoming; the active fragments are very unlikely to find the target owing to the fact that detonation takes place with the hand grenade lying on the ground, whereby the effect does not occur.

Fragmentation hand grenades have a casing which strives to spread fragments uniformly in all directions, see for instance U.S. Pat. No. 4,781,117 A. This means that the major part of the fragments is directed into the ground or into the air when detonating. Only the few fragments that start from a horizontal ring round a lying hand grenade constitute a potential danger to a lying target. An irregularity or depression in the ground which is as high as the height of a lying hand grenade constitutes a direct obstacle to a hit. A minimum irregularity in the ground affords the target natural protection also at a distance of less than 1 m. It is also highly probable that such obstacles exist in each throw.

A solution to this problem is demonstrated in U.S. Pat. No. 5,866,841 A where a hand grenade has a plurality of legs which are unfolded and raise the hand grenade to a vertical position after it has come to rest on the ground. This means that no fragments will be directed into the ground where their effect is wasted. However, there remains the problem with irregularities that still constitute an obstacle to a hit. Besides, in combat using hand grenades a target will only by mistake be located in a position other than lying and thus is not exposed to the fragments. This means that the excellent penetration values of a modern hand grenade do not matter since the fragments will not reach the target.

SUMMARY OF THE INVENTION

The invention solves the above problem by a hand grenade being caused to jump 1–2 m above the ground before detonating. Thus the fragments will attack the target from above, which results in a target surface that is many times larger and makes it possible to give off fragments behind a shelter.

BRIEF DESCRIPTION OF THE DRAWINGS

The invention will now be described in more detail with reference to the following Figures.

DETAILED DESCRIPTION OF THE PREFERRED EMBODIMENTS

Figure 1:
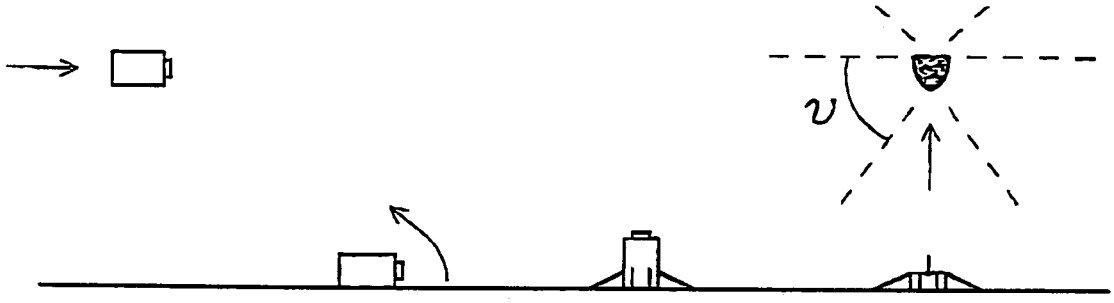
FIG. 1 shows the use of a hand grenade according to the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

A hand grenade according to the present invention is handled largely as an ordinary hand grenade. Once the hand grenade is thrown, a pyrotechnic delay unit (3) starts in the hand grenade detonator (2). As the hand grenade lands in the target area and is lying still on the ground, the delay unit (3) releases a pyrotechnic charge (4) in the upper part of the hand grenade detonator which shoots away a locking cover (8) from the upper side of the hand grenade. When the locking cover (8) has been removed, a number of support legs/spring legs (9), such as five or six legs, are released, which are articulated to a spring leg mounting (10) in the bottom of the hand grenade. The support legs (9) unfold at 90 degrees in all directions and raise the hand grenade from a lying horizontal position to a standing vertical position, with the mechanism (1) facing upwards and the spring leg mounting (10) in the bottom surrounded by the support legs (9) which form a star-shaped support against the ground. A lump assembly including a guide tube (7) is fastened centrally in the spring leg mounting (10) by a thread and moves loosely in a tubular duct (19) through the grenade body. The guide tube (7) extends through the entire grenade body and terminates in contact with the hand grenade detonator (2) in the upper part of the grenade. The delay unit (3) initiates a pyrotechnic jump charge (5) in the bottom of the hand grenade detonator. The gas pressure from the charge (5) acts on the guide tube end surface (18). The guide tube (7), which is in contact with the ground by the intermediary of a base plate (16), will be pressed against the ground whereas the hand grenade will be pressed upwards. When the hand grenade has reached a height of 1–2 m, the delay unit (3) releases an explosive cartridge (6) in the lowermost part of the detonator. The explosive cartridge (6) ignites the main charge (13) of the hand grenade which detonates. If an airburst is not desired, the guide tube (7) can be unscrewed from the spring leg mounting (10) in one motion and removed from the hand grenade, thereby preventing jumping. The detonation then occurs lying on the ground.

Figure 2:
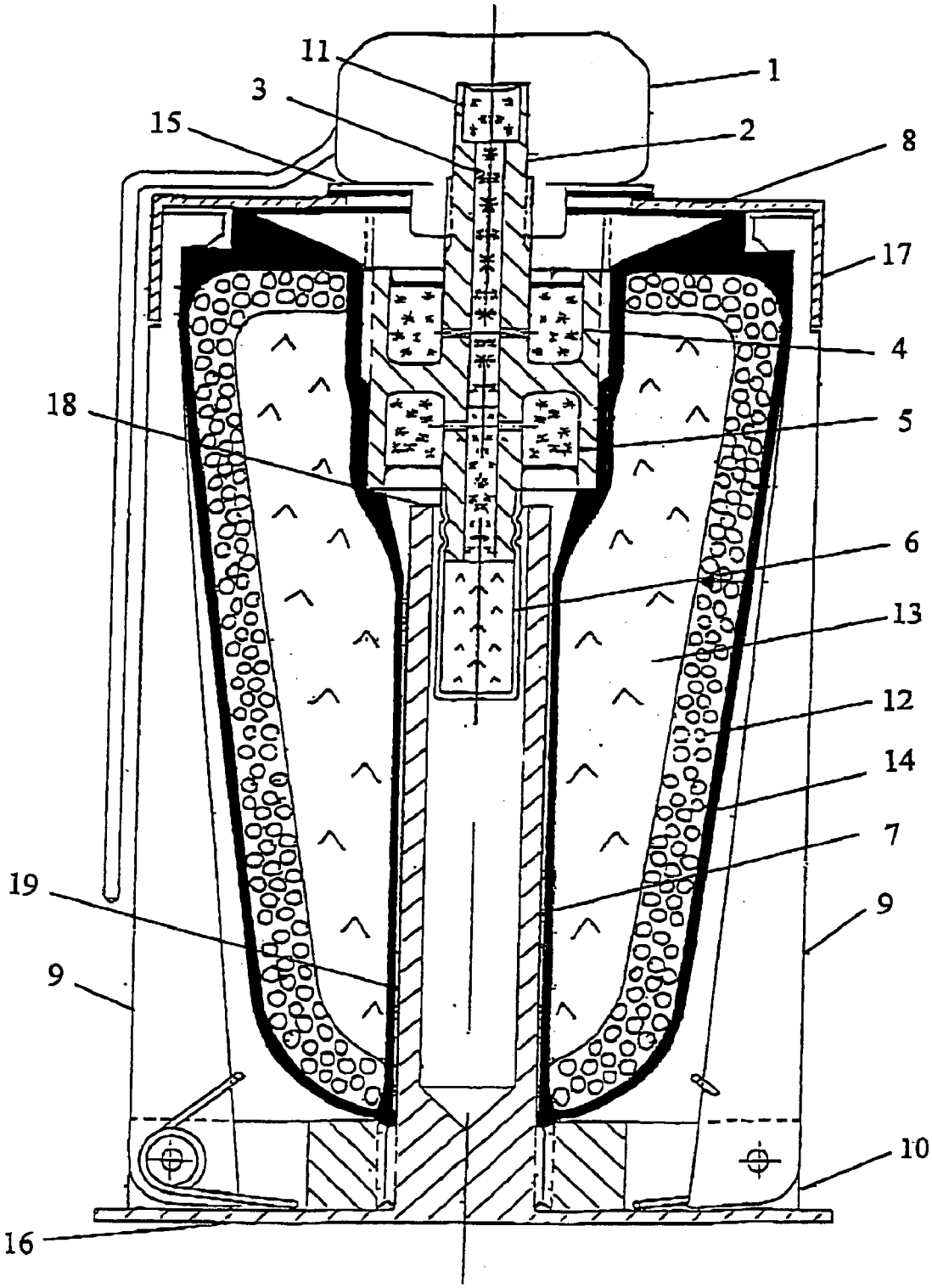
FIG. 2 is an exploded view of a hand grenade according to the invention.

FIG. 2 is an exploded view of a preferred embodiment of a hand grenade according to the invention. The hand grenade has a mechanism (1) which can be a prior-art standard mechanism with striking pin, mainspring, handle and safety catch. The lower part of the mechanism housing is provided with a fixedly joined circular sheet (15) whose diameter is slightly larger than the mechanism housing. The sheet (15) serves as a seal against and holder of the locking cover (8) on the upper side of the hand grenade. The mechanism (1) has an internal thread for the hand grenade detonator (2).

The locking cover (8), is a cylindrical cover, which fits tightly over the upper part of the grenade body. Its edges (17) extend somewhat down along the sides of the grenade body and lock the spring legs (9) against the sides of the grenade body.

Centrally there is circular hole whose diameter is slightly smaller than the sheet (15) of the mechanism housing, which sheet can thus hold the locking cover (8) in place, squeezed between the mechanism sheet (15) and the grenade body. Here are also moisture-proof seals arranged. When the upper pyrotechnic charge (4) of the hand grenade detonator is initiated, a gas pressure is generated, which acts against the underside of the locking cover with such a force that the locking cover (8) is deformed and urged past the mechanism (1). When the locking cover (8) has been removed, the spring legs (9) are released.

The hand grenade detonator (2) consists of a continuous tube with a cylindrical waist with an increased diameter. In the upper part of the tube there is a detonating composition (11) which is initiated by the striking pin of the mechanism. From the detonating composition (11) extends, axially through the tube, a duct containing a delay unit (3) which in the lower part may pass into another unit of a pressed type with improved time performance. The delay unit is in this example a pyrotechnic unit but may just as well be electric. An explosive cartridge (6) is arranged in the lower part of the tube. The waist surrounding the tube has an upper and a lower space which are separated from each other by intermediate material. The circumferential surface of the waist is provided with a thread connecting to the upper part of the grenade body. The upper space will thus be located on the outside of the grenade body and the lower space in the interior of the grenade body immediately above the inserted guide tube (7). Both spaces are axial recesses in the material of the waist, which annularly surround the tube. The spaces communicate with the delay unit (3) of the tube through one or more radial apertures (20). The spaces are filled with a pyrotechnic unit (4, 5) whose function in the upper case is to remove the locking cover (8) and, in the lower, to generate gas pressure to cause jumping upwards. The charges (4, 5) are environmentally protected by varnish, lids or the like. The upper part of the tube is provided with a thread to which the hand grenade mechanism (1) connects. Between 2 and 2.5 s after the delay unit (3) of the tube has been initiated, the first pyrotechnic charge (4) will fire away the locking cover (8), the removal of which releases the spring legs (9) which in turn raise the hand grenade to an upright position. After further 0.5 to 1 s, the inner charge (5), the jump charge, is initiated and throws the hand grenade upwards between 1 and 2 m. Finally, when an optimal height has been reached, the delay charge (3) triggers the explosive cartridge (6) and the hand grenade bursts. The times mentioned above are approximations and calibrates to achieve an optimal effect.

The guide tube (7) moves freely but in a moisture-proof manner in a duct (19) in the core line of the grenade body. Its upper end connects to the hand grenade detonator (2) and the jump charge (5) thereof. There it also encloses the explosive cartridge (6) which in its entirety extends into the tube (7). The guide tube (7) thus constitutes an interruption in the ignition chain, I.e. before a jump has occurred or the guide tube (7) has been removed, initiation of the main charge (13) cannot take place. This is an important improvement of safety compared with prior-art constructions where the explosive cartridge is stored separately and fastened in the hand grenade when required. The lower part of the guide tube is fastened in the centre of the spring leg mounting (10) by a continuous thread.

The guide tube (7) is held vertically upright by the unfolded spring legs (9) and thus also the hand grenade body. When the jump charge (5) is initiated, the gas pressure will act on the end surface (18) of the tube and a force will arise between the guide tube (7) and the grenade body. The relatively great length of the guide tube will guide the grenade body to maintain its orientation also during the jump phase. Here also a minor rotation may be introduced if required for stability, for instance by grooving. A fixedly connected base plate (16) is arranged under the thread of the guide tube. Thus the base plate (16) is positioned under the spring leg mounting (16) and constitutes the lower boundary of the hand grenade and its contact surface on the ground. The base plate (16) is given a suitable design to increase friction against the ground if rotation is necessary. The base plate (16) has a somewhat larger diameter than the spring leg mounting (10) with the spring legs (9) folded back and its edge is grooved so as to provide a good grip for the thrower's fingers. The thrower can thus easily unscrew and remove the guide tube (7) and thus also the base plate (16) immediately prior to throwing if a ground detonation is desired. Alternatively the guide tube (7) and the base plate (16) with thread can be separate parts which only move in each other. Then the jump function would not occur if the base plate (16) was removed and thus the mounting of the guide tube was removed. The guide tube (7) would remain in the grenade body and consequently still constitute an interruption in the ignition chain until the guide tube (7) is fired away by the pyrotechnic charge (5).

In the preferred embodiment, six support legs/spring legs (9) are uniformly distributed round the grenade body. They are locked in the upper part of the edge (17) of the locking cover and are articulated to the spring leg mounting (10) where also the spring function is to be found. Under the edge (17) of the locking cover, the upper part of the spring legs (9) hooks into a shoulder or a notch in the grenade body which locks the spring legs, and thus also the spring leg mounting to the grenade body in a fixed position. The locking ceases by the locking cover (8) being removed. Then the spring legs (9) unfold at 90 degrees from the core line of the grenade body and raise the lying hand grenade. The spring legs (9) are either separate components which jointly cover the circumferential surface of the entire grenade body and are therefore formed to good gripping surfaces for the thrower's hand, or somewhat lowered into grooves in the circumferential surface and may then consist of merely the springs themselves.

The spring leg mounting (10) is a sheet which is separate from the grenade body and which in its periphery constitutes the point of articulation for the spring legs (9) and the abutment for the prestressed springs. The abutment for the springs may also consist of the guide tube base plate (16) which directly engages the underside of the mounting. Consequently the base plate (16) of the guide tube will obtain automatic friction locking while at the same time the spring force in the raising function does not occur when a ground detonation is selected, which may be desirable. The guide tube (7) is positioned in the centre of the spring leg mounting (10) in a threaded through hole.

The warhead (14) of the grenade body consists of a shell of preformed fragments (12) cast into a plastic matrix. In the grenade body, a suitable explosive is cast to a main charge (13). Centrally in the core line of the grenade body there is a continuous plastic lined duct (19). The threaded joint for the hand grenade detonator (2) is arranged at the upper end of the duct. There are also surface ducts arranged for distribution of the gas pressure from the upper pyrotechnic charge (4) to the inner surface of the locking cover. At the lower end there is a moisture-proof seal against the guide tube (7) which runs in the duct. The guide tube (7) guides the grenade so that the mechanism (1) is oriented upwards at the moment of detonation. Thus the entire underside and also the sides of the grenade may be given such a softly rounded conical shape that the major part of the total number of fragments of the hand grenade are directed downwards to the circle on the ground where the effect is to be expected. A minor part of the fragments from the top surface of the grenade body are allowed to be spread upwards so that a certain degree of coverage in that direction is obtained if a ground detonation has been selected. The shape and material of the fragments are selected so that an effect on predetermined targets is obtained within the desired effective radius and then ceases as soon as possible in order to minimise the risks to the thrower. Preforming of the fragments provides this possibility of guiding. The explosive in the main charge (13), and optionally a primary charge, and also the point of initiation are selected to achieve the above. The conical shape of the grenade body results in sufficient space for the spring leg mechanism in the bottom of the grenade. The spring legs (9) will also guide the contact surface of the hand grenade with the thrower's hand so that he does not have to handle a cone but a well-shaped surface.

The locking cover charge and the jump charge of the hand grenade detonator need not be symmetrical as in the drawing. The locking cover charge (4) can be shallower and have an increased diameter. The jump charge (5) should be narrower, as close as possible to the diameter of the guide tube (7). The spring legs (9) may consist of the springs themselves, without separate leg parts, which extend in grooves in the plastic casing of the hand grenade which is then adjusted for a good grip. The guide tube (7) can be made in two parts, tube and base plate (16) with thread. A cylinder having the inner diameter of the tube protrudes from the thread into the open lower part of the tube. The tube is kept in place in the duct (19) by an O-ring when the base plate (16) has been removed.

Airburst solves the problem with poor target access. If the hand grenade is made to detonate at a height of between 1 and 2 m, about half of the fragments will hit the ground within the circle where the speed of the fragments is still such that an effect may arise. Targets located within the circle will, independently of posture, expose a considerably larger surface to fragments and thus receive a many times greater amount of fragments. The angle (v) of the fragments will be from above or obliquely from above, which fully eliminates small topographical formations as shelter. Also destroyed walls, furniture, large logs, stones and pits in the ground will be wholly or partly eliminated as shelter depending on the angle (v) of the fragments. The obstructing effect of snow disappears even if the hand grenade can jump out of the snow.

According to the invention, the path of the hand grenade is controlled in the jump and, thus, without tumbling. As a result, the warhead (14) can be designed so that the fragments (12) are collected and directed towards the area where the greatest effect can be achieved, instead of being spread spherically in all directions, which increases the probability of hitting the target If a traditional ground detonation is desired, a change is made by unscrewing the guide tube (7) from the hand grenade in one motion. A hand grenade according to the invention gives a considerable improvement over prior art which spreads fragments in all directions and in which the major part of the fragments will be lost.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A hand-throwable grenade comprising a detonator initiating mechanism that is activated by an operator before said hand grenade is thrown, a detonator, a warhead having a main charge, a device constituting part of said hand grenade for raising the hand grenade from a horizontal position to an upright position after said hand grenade has been thrown and has landed, and a jump assembly operable with said detonator for propelling the warhead into the air from said upright position for mid-air explosion thereof.

2. The hand grenade as claimed in claim 1, wherein the detonator is thrown into the air with the warhead to initiate the main charge.

3. The hand grenade as claimed in claim 1, wherein the device for raising the hand grenade from the horizontal position to the upright position includes support legs arranged round the hand grenade in a spring leg mounting and held in an upright position against a body of said hand grenade by a locking cover prior to deployment.

4. The hand grenade as claimed in claim 3, wherein the detonator includes a pyrotechnic charge for removing the locking cover to release the support legs.

5. The hand grenade as claimed in claim 1, wherein the detonator includes a jump charge operable with said jump assembly to propel the warhead into the air.

6. The hand grenade as claimed in claim 5, wherein the jump assembly includes a guide tube movingly arranged in a duct in the warhead and configured, upon detonation of said jump charge, to guide the warhead in an upward direction.

7. The hand grenade as claimed in claim 6, wherein the guide tube is configured to guide the warhead in said upward direction by rotating the warhead.

8. The hand grenade as claimed in claim 1, wherein the hand grenade includes a safety device configured to prevent an explosive cartridge of the detonator from initiating the main charge.

9. The hand grenade as claimed in claim 8, wherein the safety device includes a guide tube of said lump assembly, said guide tube being arranged between the explosive cartridge of said detonator and the main charge.

10. The hand grenade as claimed in claim 1, wherein the hand grenade jump assembly includes a base plate frictionally engaged against the ground to allow controlled propelling of the warhead into the air.

11. The hand grenade as claimed in claim 1, wherein the detonator includes a delay unit, an upper charge for enabling said device to raise the hand grenade to said upright position, a jump charge capable of propelling the warhead above the ground, and an explosive cartridge capable of initiating the main charge.

12. The hand grenade as claimed in claim 11, wherein the delay unit is a pyrotechnic delay unit or an electrical delay device.

13. The hand grenade as claimed in claim 1, wherein the warhead includes an axial duct, and the jump assembly includes a guide tube slidably arranged in said duct.

14. The hand grenade as claimed in claim 1, wherein the device for raising the hand grenade includes two or more support legs articulated to a spring leg mounting, said support legs being resiliently raised to an upright position along the warhead and held in said upright position by a locking cover.

15. The hand grenade as claimed in claim 14, wherein the lump assembly includes a guide tube and a base plate releasably arranged on the spring leg mounting, said base plate frictionally engaged with the around and said guide tube movably arranged in said warhead.

16. The hand grenade as claimed in claim 6, wherein the guide tube includes an upper end surface on which combustion gases of the jump charge act to propel the warhead into the air.

17. The hand grenade as claimed in claim 15, wherein the hand grenade can be made to burst resting on the ground by manually removing the guide tube and/or the base plate.

18. A hand grenade comprising:

a detonator having a pyrotechnic charge and a jump charge;

a warhead having a guide element movably arranged therein;

spring members for raising the hand grenade from a horizontal position to an upright position, said spring members being held at a base of said grenade in a spring leg mounting and fixed to a top of said grenade by a locking cover;

said pyrotechnic charge, upon detonation, forcing the locking cover upward to release said spring members to raise said hand grenade to the upright position; and said jump charge, upon detonation and in conjunction with said guide element, for propelling the warhead into the air before it bursts.

19. The hand grenade as claimed in claim 18, wherein said detonator further comprises an explosive cartridge capable of initiating a main charge of said warhead.

20. The hand grenade as claimed in claim 19, wherein said guide element is arranged between the explosive cartridge and the main charge and prevents detonation of said main charge until said guide element is removed from said warhead by detonation of said jump charge or by manual removal.

21. A hand grenade comprising:

a mechanism for initiating the hand grenade;

a detonator;

a warhead having a main charge and a movable guide element operable with said detonator to propel the warhead into the air before said main charge is detonated;

releasable members for raising the hand grenade from a horizontal position to an upright position after said grenade has been deployed, said members being secured adjacent an outer part of said warhead by a locking cover prior to said deployment;

said detonator including a delay unit, a first charge capable of releasing said members by removing said locking cover, a second charge operable with said guide element to propel said warhead into the air for mid-air explosion thereof, and an explosive cartridge for initiating the main charge.

22. The hand grenade as claimed in claim 21, wherein the delay unit is a pyrotechnic delay unit or an electrical delay device.

* * * * *